US006133681A

United States Patent [19]

Nakamura et al.

[11] Patent Number: 6,133,681

[45] Date of Patent: Oct. 17, 2000

[54] COLOR PICTURE TUBE DEVICE HAVING CONTOURED PANEL AND AUXILIARY COIL FOR REDUCING APPARENT SCREEN DISTORTIONS

[75] Inventors: Koji Nakamura; Akira Inoue, both of Tokyo, Japan

[73] Assignee: Mitsubishi Denki Kabushiki Kaisha, Tokyo, Japan

[21] Appl. No.: 09/090,085

[22] Filed: Jun. 4, 1998

[30] Foreign Application Priority Data

| | | | |
|---|---|---|---|
| Sep. 2, 1997 | [JP] | Japan | 9-236866 |
| Sep. 2, 1997 | [JP] | Japan | 9-236867 |
| Nov. 14, 1997 | [JP] | Japan | 9-313644 |

[51] Int. Cl.[7] ..... H01J 29/80

[52] U.S. Cl. ..... 313/402; 313/461; 313/477 R

[58] Field of Search ..... 313/402, 364, 313/461, 477 R, 479, 408; 220/2.1 A, 2.1 R, 2.3 A, 2.3 R

[56] References Cited

U.S. PATENT DOCUMENTS

| | | | |
|---|---|---|---|
| 4,537,322 | 8/1985 | Okada et al. | 220/2.1 A |
| 4,570,101 | 2/1986 | Campbell | 313/461 |
| 4,777,401 | 10/1988 | Hosokoshi et al. | 313/461 |
| 4,985,658 | 1/1991 | Canevazzi | 313/477 R |
| 5,107,999 | 4/1992 | Canevazzi | 220/2.1 A |
| 5,216,321 | 6/1993 | Kawamura et al. . | |
| 5,276,377 | 1/1994 | Van Nes et al. | 313/461 |

FOREIGN PATENT DOCUMENTS

| | | |
|---|---|---|
| 0443657 A1 | 8/1991 | European Pat. Off. . |
| 0860852 A2 | 8/1998 | European Pat. Off. . |
| 2-148544 | 6/1990 | Japan . |
| 6-36710 | 2/1994 | Japan . |
| 7-122205 | 5/1995 | Japan . |
| 7-142012 | 6/1995 | Japan . |
| 9-245685 | 9/1997 | Japan . |

OTHER PUBLICATIONS

G. Adachi et al, "5.1: Super–Flat–Face Large–Size–Screen Color CRT", SID International Symposium Digest of Technical Papers, Anaheim, May 6–10, 1991, vol. 22, May 6, 1991, pp. 37–40.

Nomi Makoto, "Display Control Circuit and Device", Patent Abstracts of Japan, vol. 18, No. 252, Publication No. 06036710, Feb. 2, 1994, Application No. 04193657 dated Jul. 21, 1992 (English Abstract Only).

*Primary Examiner*—Nimeshkumar D. Patel
*Assistant Examiner*—Matthew J Gerike

[57] ABSTRACT

An object is to remove unnaturalness of the picture caused by inferior flatness of the apparent screen and provide a safety-designed color picture tube device having a flatter apparent screen without deterioration of static strength of the picture tube. The upper half of the panel (the part above the Z-axis) shows the vertical-axis (V) section and the lower half (the part below the Z-axis) shows the horizontal-axis (H) section. The outside surface of the panel is in a convex form with respect to the Z-axis in the vertical-axis (V) section with a radius of curvature of ROV and is in a convex form with respect to the Z-axis in the horizontal-axis (H) section with a radius of curvature of ROH. The inside surface of the panel is in an almost linear form in the vertical-axis (V) section with a radius of curvature of RIV and is in a convex form with respect to the Z-axis in the horizontal-axis (H) section with a radius of curvature of RIH.

20 Claims, 15 Drawing Sheets

TREND OF OUTSIDE SURFACE
ROV<ROH<ROD

TREND OF INSIDE SURFACE
RIH<RIV

COLOR PICTURE TUBE DEVICE HAVING CONTOURED PANEL AND AUXILIARY COIL FOR REDUCING APPARENT SCREEN DISTORTIONS

BACKGROUND OF THE INVENTION

1. Field of the Invention

The present invention relates to a color picture tube device having a tension-type shadow grille.

2. Description of the Background Art

FIG. 21 is a partially sectional side view showing a conventional color picture tube device having a tension-type shadow grille. In FIG. 21, 1 denotes a panel forming the envelope of the color picture tube, 2 denotes a funnel forming the envelope of the color picture tube together with the panel 1, 3 denotes a phosphor screen formed by arranging red, blue and green phosphors in order on the inside surface of the panel, 4 denotes an electron gun, 5 denotes electron beam emitted from the electron gun, 6 denotes a deflection yoke for electromagnetically deflecting the electron beam 5, and 7 denotes a tension-type shadow grille serving as a color-selecting electrode.

FIG. 22 shows the structure of the conventionally used tension-type shadow grille 7. In FIG. 22, 8 denotes a frame formed of a steel material such as stainless steel (SUS), for example, and 10 denotes an aperture grille 10 having slit-like apertures 11 and tape-like elongate pieces 9 formed of 0.1-mm-thick rimmed steel, for example. The aperture grille 10 is fixed and held by welding on the frame 8, while being tensed in one direction. The character 10*a* denotes damper wire and 10*b* denotes damper spring.

Next, the operation will be described. The inside of the color picture tube is kept at a high vacuum with the envelope formed of the panel 1 and the funnel 2. The electron beam 5 emitted from the electron gun 4 is led to strike the high-voltage-applied phosphor screen 3 on the inside surface of the panel 1 and causes it to emit light. At the same time, the electron beam 5 is deflected from side to side and up and down by the deflecting magnetic field formed by the deflection yoke 6, which forms a picture display area called a raster on the phosphor screen 3. A picture is seen in this picture display area by observing, from the outside of the panel 1, the distribution of the red, blue, and green luminous intensities on the phosphor screen 3 corresponding to the quantity of irradiation of the electron beam 5. An enormous number of slit-like apertures 11 are arranged in order on the shadow grille. The electron beam 5 passes through the apertures 11 to geometrically strike given position on the red, blue, and green phosphor stripes on the phosphor screen 3 for correct color selection. The shadow grille 7 formed of the tape-like elongate pieces 9 is tensed in one direction by the frame 8.

FIG. 23 is a front view of the phosphor screen 3 seen from the viewer side. In FIG. 23, the center of the phosphor screen 3 is shown as the Z-axis in the direction perpendicular to the screen, and the vertical direction is shown at V and the horizontal direction at H. The distances from the center axis Z to an end of the vertical axis V and an end of the horizontal axis H are taken as 1*v* and 1*h*, respectively. For the relation between the structure of the shadow grille 7 and the phosphor screen 3, the V direction corresponds to the tape-like elongate pieces 9 and the tape-like elongate pieces 9 are tensed in the vertical direction V.

The recent technical trend in conventional color picture tube devices having such structure is toward flat panels (phosphor screens). Since conventionally used color picture tubes are made of vacuum chambers of glass, flat panels have not been used for weight reduction. On the other hand, recent advancement of the technology, coupled with development in simulation technology, is enabling the use of flatter panels. According to experiments made by the inventors, however, as shown in FIG. 24, when a face of a man is imaged in a close-up in a picture tube having a perfectly flat plane-parallel plate glass as the panel 1, for example, the man's face looks as if it was concave in the center.

The reason for this will be described with the panel 1 formed of a plane-parallel plate glass shown in FIG. 24. In FIG. 24, the upper half (above the Z-axis) shows the section in the vertical axis (V) direction and the lower half (below the Z-axis) shows the section in the horizontal axis (H) direction. In this case, when the viewer 19 sees the phosphor screen 3 on the panel 1 at a point separated by 95 mm from the panel 1, for example, an apparent screen 20 forms as shown by the one-dot chain line in FIG. 25. That is to say, while, in the center of the screen, it is seen at a position raised by about one-third of the thickness T0 of the panel glass, it further warps up by ΔT as it approaches the periphery of the screen. Accordingly, when seen from the viewer 19, the apparent screen 20 is dented in the center as shown by the one-dot chain line. This causes the man's face to be seen as if it was concave in the center.

FIG. 26 shows a conventional example of an improvement for this problem, where, like in FIG. 24, the part above the Z-axis shows the section in the vertical axis (V) direction and the part below the Z-axis shows the section in the horizontal axis (H) direction. This panel 1 is flat in the vertical direction and has a wedge Δ TH in the peripheral part of the screen in the horizontal direction. In this case, the apparent screen 20 forms as shown by the one-dot chain line 20 in FIG. 27. That is to say, in the vertical direction, it is the same as that formed in the conventional flat panel. In the horizontal direction, the apparent screen is made flatter, which is a remarkable improvement as compared with the conventional plane-parallel plate panel 1. However, the insufficient flatness in the horizontal direction and the problem of flatness in the vertical direction still produce an uncomfortable impression.

SUMMARY OF THE INVENTION

According to a first aspect of the present invention, in a color picture tube device having a panel forming an envelope and a tension-type shadow grille provided to face a screen formed on the inside surface of the panel, the axis extending from the center of the screen toward a viewer in a perpendicular direction corresponds to a Z-axis, wherein the panel has its outside surface shaped in a convex form in the Z-axis direction in the sections in both of the directions along the vertical and horizontal axes of the screen, and the panel has its inside surface shaped in an almost linear form in the section in the vertical axis direction and in a convex form with respect to the Z-axis in the section in the horizontal axis direction.

According to a second aspect of the present invention, in a color picture tube device having a panel forming an envelope and a tension-type shadow grille provided to face a screen formed on the inside surface of the panel, the panel has its outside surface shaped in an approximately flat form with a radius of curvature of R6000 or larger, and the panel has its inside surface shaped in a convex form with respect to the Z-axis in the sections in the vertical axis direction and in the horizontal axis direction.

According to a third aspect of the present invention, in a color picture tube device having a panel forming an envelope and a tension-type shadow grille provided to face a screen formed on the inside surface of the panel, the inside surface of the panel is formed in an aspherical surface of a non-cylindrical surface so that the thickness at the periphery of the panel corresponding to the screen is larger than the thickness at the center of the panel and so that the thickness in the section in the vertical axis direction of the panel corresponding to the screen is different from the thickness in the section in the horizontal axis direction.

Conventionally, since it was impossible to adjust the apparent rise of the screen in the vertical direction, the apparent screen had anisotropy leading to inferior flatness. The first to third aspects of the color picture tube device having a tension-type shadow grille of the present invention solve this problem.

Furthermore, conventional color picture tube panels had problems in static strength of the picture tubes to some extent, since they had no wedge. The present invention solves or alleviates this problem, thereby providing a structure with a more desirable, flatter screen.

An object of the present invention is to remove unnaturalness of images caused by inferior flatness of the apparent screen and provide a safety designed color picture tube device having a picture tube free from deterioration of static strength and a flatter apparent screen.

Moreover, since it can use a conventional type shadow grille tensed in the vertical direction as it is, it does not require development of new parts.

The above objects, features, aspects and advantages of the present invention will become more apparent from the following detailed description of the present invention when taken in conjunction with the accompanying drawings.

DESCRIPTION OF THE PREFERRED EMBODIMENTS

A. FIRST PREFERRED EMBODIMENT

A-1. Device Structure

Figure 1:
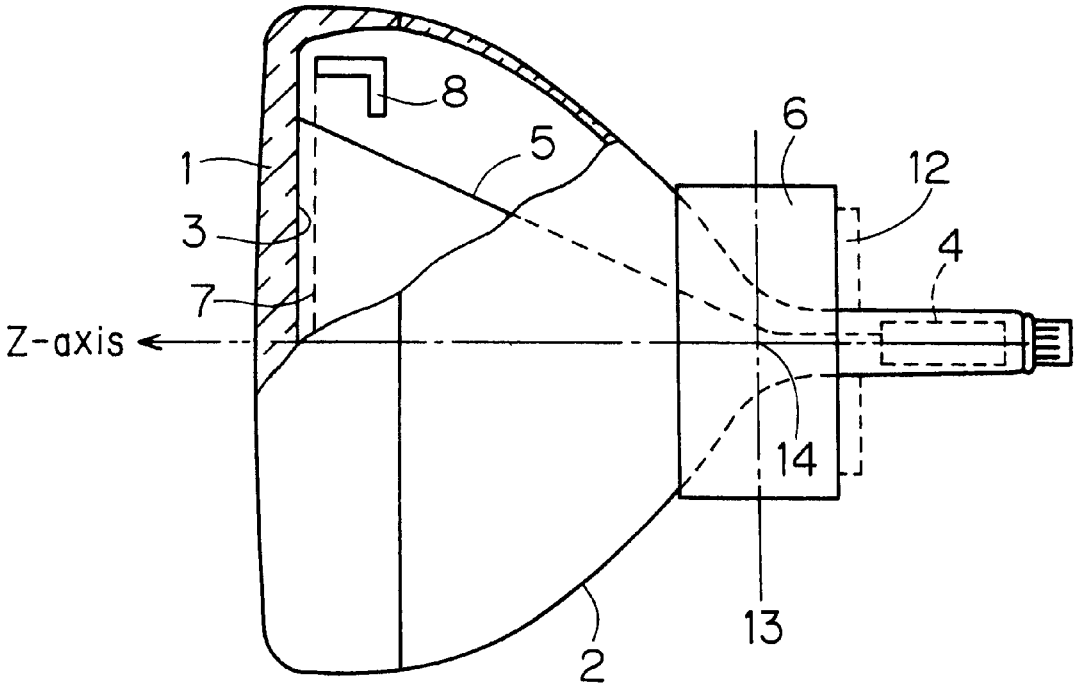
FIG. 1 is a partially sectional side view showing a color picture tube having a tension-type shadow grille according to a first preferred embodiment of the present invention.
Figure 21:
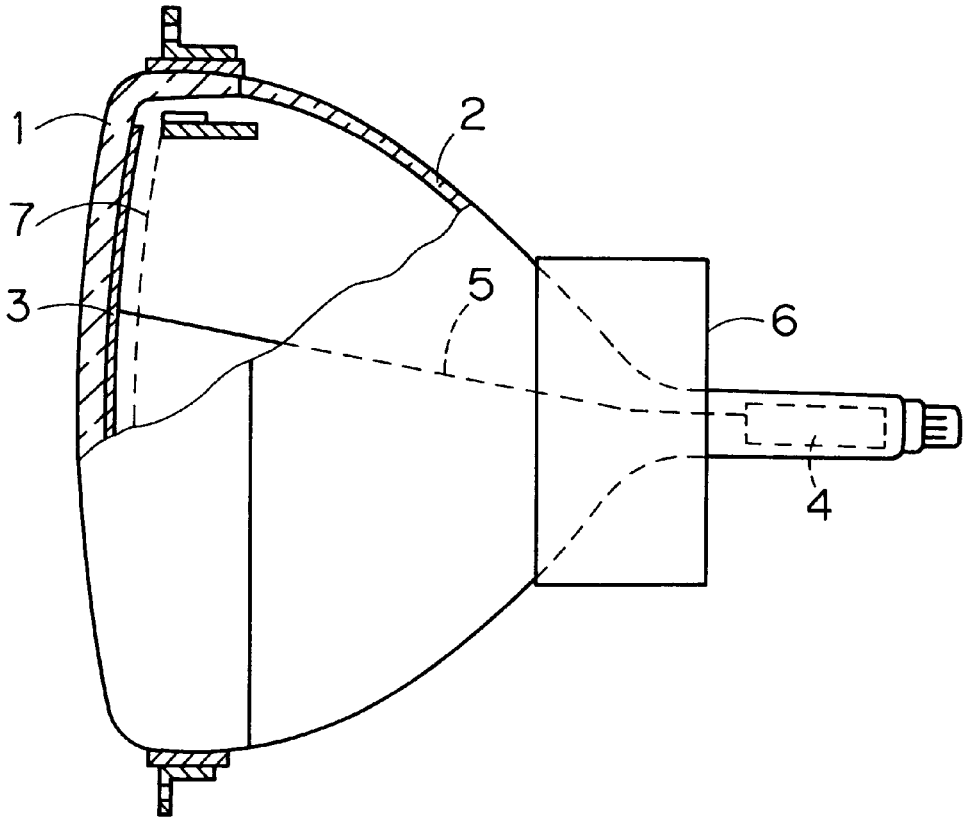
FIG. 21 is a partially sectional side view showing a conventional color picture tube device.
Figure 22:
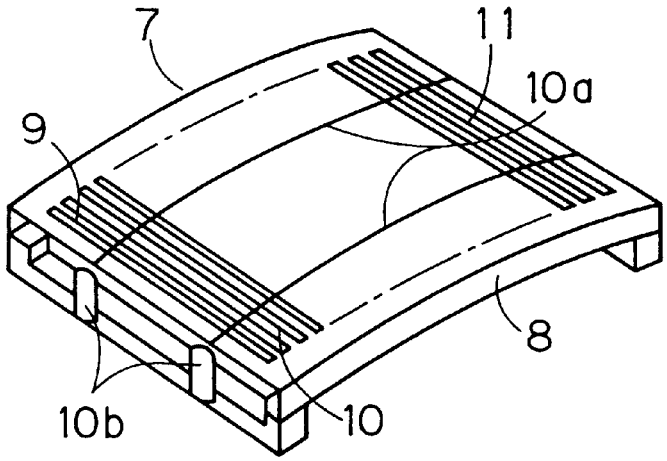
FIG. 22 is a perspective view showing a tension-type shadow grille used in the conventional color picture tube device.

A first preferred embodiment of the present invention will now be described with a picture tube having a diagonal dimension of 51 cm. The picture tube device of the first preferred embodiment shown in FIG. 1 has the same structure as the conventional picture tube device shown in FIG. 21 except in the shape of the panel 1, the deflection yoke 6, and an auxiliary coil 12 added as needed. Specifically, in FIG. 1, 1 denotes a panel forming the envelope of the color picture tube, 2 denotes a funnel forming the envelope of the color picture tube (CRT) together with the panel 1, 3 denotes a phosphor screen formed by arranging red, blue, and green phosphors in order on the inside surface of the panel, 4 denotes an electron gun, 5 denotes the electron beam emitted from the electron gun 4, 6 denotes a deflection yoke for electromagnetically deflecting the electron beam 5, and 7 denotes a tension-type shadow grille serving as a color-selecting electrode. The structure of the tension-type shadow grille 7 is not described again since it has been already described referring to FIG. 22. The shadow grille 7 tensed in one direction has the characteristic that it provides more excellent picture quality as compared with a shadow mask tensed in an isotropic manner (in all directions) such as a shadow mask having dot-like apertures.

The panel 1 has its outside surface shaped in a convex form both in the vertical axis and horizontal axis directions and its inside surface shaped in an almost linear section in the vertical axis direction and in a convex section with respect to the Z-axis in the horizontal axis direction. While the deflection yoke 6 is apparently the same as conventional ones, it differs in respect of the deflecting magnetic field, especially in respect of the magnetic field produced by the vertical coil. An auxiliary coil 12 may be provided on the electron gun side of the deflection yoke 6. An imaginary deflection center plane 13 exists almost in the middle of the deflection yoke 6, which intersects the Z-axis to form the deflection center 14.

Figure 2:
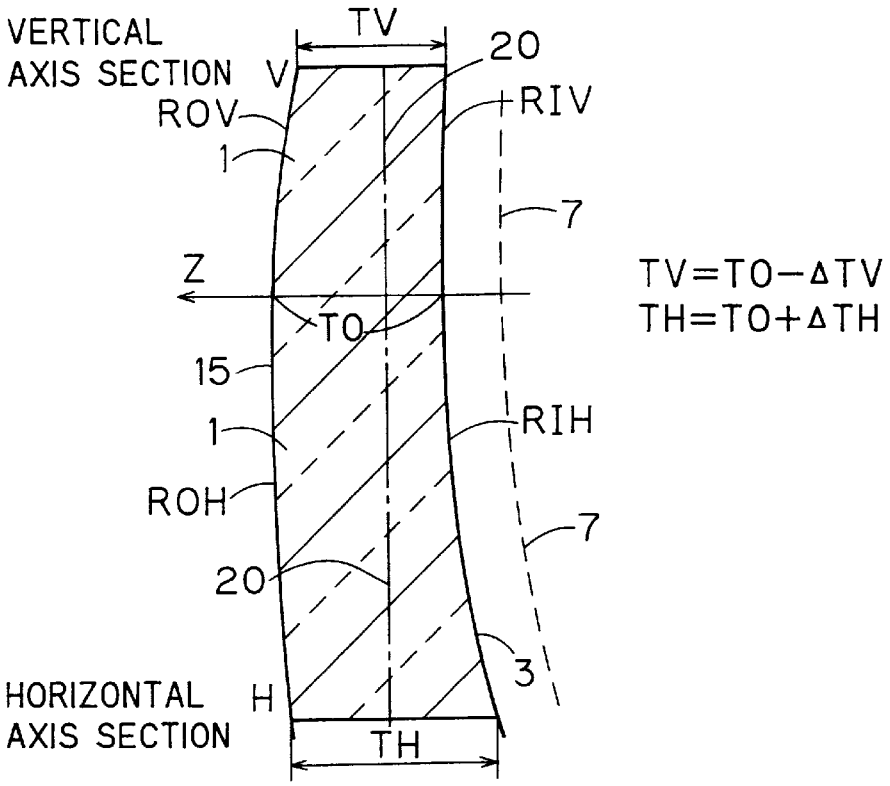
FIG. 2 is a sectional view showing the panel portion for illustrating operation of the first preferred embodiment.

FIG. 2 is a sectional view showing, in an enlarged manner, the main part of the panel 1, the phosphor screen 3 and the tension-type shadow grille 7 of this preferred embodiment. The upper half in the diagram (the part above the Z-axis) shows the vertical-axis (V) section and the lower half (the part below the Z-axis) shows the horizontal-axis (H) section. As is clear from the drawing, for the outside surface of the panel, the vertical-axis (V) section is convex with respect to the Z-axis with its radius of curvature ROV, and its horizontal-axis (H) section is convex with respect to the Z-axis with its radius of curvature ROH. For the inside surface of the panel, the vertical-axis (V) section is almost linear with its radius of curvature RIV and the horizontal-axis (H) section is convex with respect to the Z-axis with its radius of curvature RIH.

Figure 23:
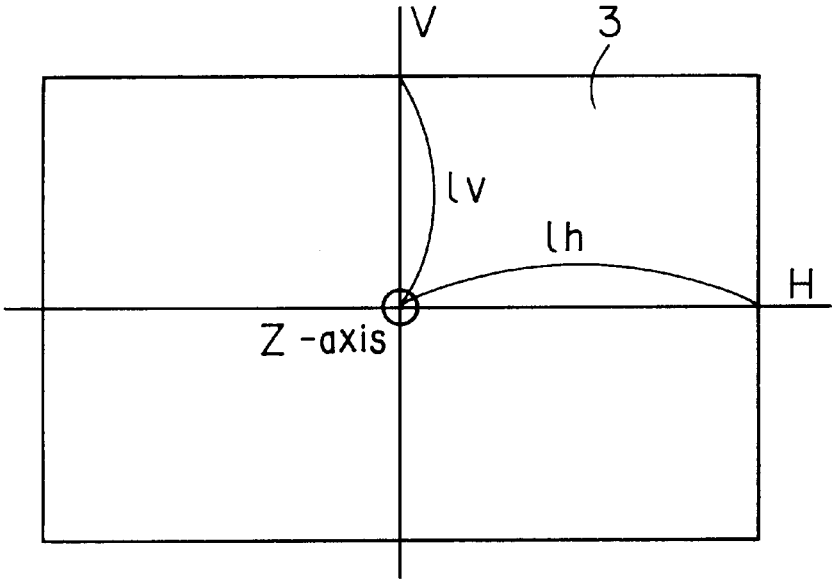
FIG. 23 is a diagram illustrating the coordinate system of the screen.
Figure 24:
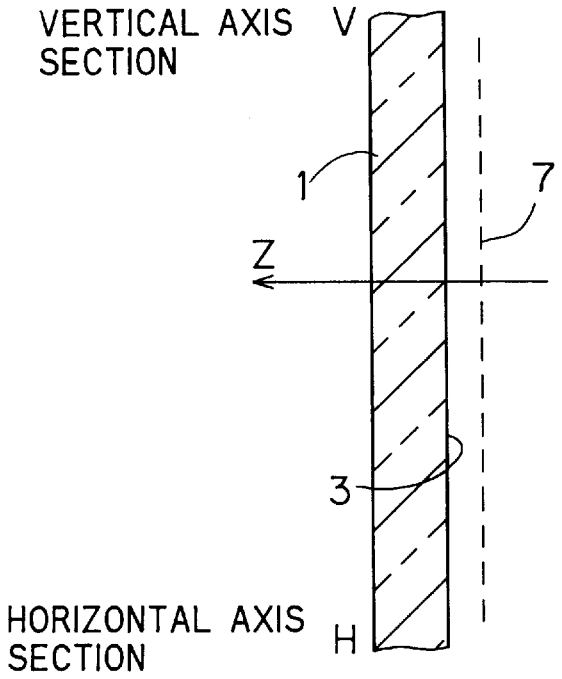
FIG. 24 is a sectional view showing a conventional plane-parallel plate panel.
Figure 25:
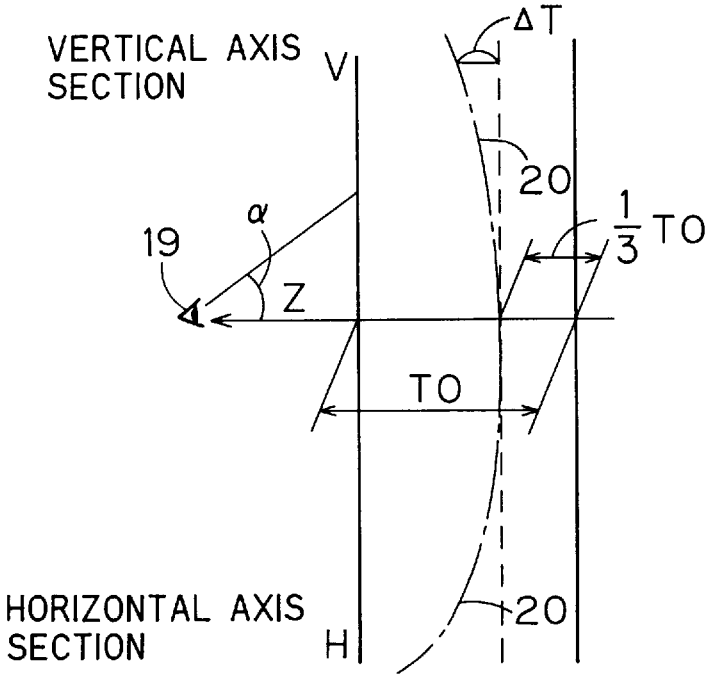
FIG. 25 is a diagram illustrating characteristics of the conventional plane-parallel plate panel.

When the glass thickness at the center of the panel 1 is taken as T0, the glass thickness TV of the panel 1 at an end of the vertical axis (X) is given as TV=T0−ΔTV. Similarly, the glass thickness TH of the panel 1 at an end of the horizontal axis (H) is given as TH=T0+ΔTH. The characters ΔTV and ΔTH correspond to the differences between the thickness T0 and those at the distances 1*v* and 1*h* from the screen center Z described referring to FIG. 23, which are referred to as "wedge" hereinafter.

Since the shadow grille 7 is tensed in the vertical axis (V) direction, it is in an almost linear form in cross-section in the vertical direction. The shape of the shadow grille 7 in the horizontal direction forms a curved surface determined on the basis of the pitch a of the slit-like apertures 11, the shape of the inside surface of the panel 1 and the off-axis dimension SB from the Z-axis of the both-side electron beams at the deflection center plane 13 (refer to FIG. 1). For the both-side electron beams, if G is considered as the center among the three electron beams R, G and B, the both-side electron beams correspond to R and B.

A-2. Operation

Figure 4:
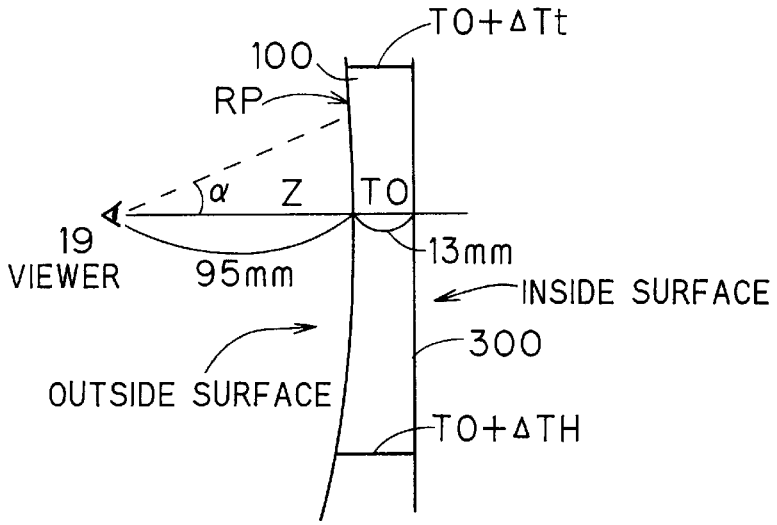
FIG. 4 is a sectional view showing the panel portion for illustrating the principle of the present invention.

For the purpose of describing effects of the present invention, the reason why the apparent screen raises the problem when a conventional plane-parallel plate glass panel is used will be described in detail referring to FIG. 4 and FIG. 5. FIG. 4 is a diagram showing arrangement in a model unit of the panel for calculating how the phosphor screen 300 looks raised when the viewer 19 sees the phosphor screen 300 applied on the inside surface of a flat panel from the position 95-mm away from the outside surface of the panel 100. Here, the distance between the viewer 19 and the outside surface of the panel 100 is given as 95 mm by supposing the worst technical estimation. In this sample of calculations, the outside surface of the panel 100 is not limited to a flat one, but it is assumed to be a spherical radius (S.R) in a concave form with respect to the Z-axis with its radius of curvature being variable. It is assumed that the inside surface is flat and the phosphor screen 300 is provided thereon. The thicknesses at the periphery in this case are taken as T0+ΔTV at an end of the vertical axis of the screen and as T0+ΔTH at an end of the horizontal axis of the screen.

Figure 5:
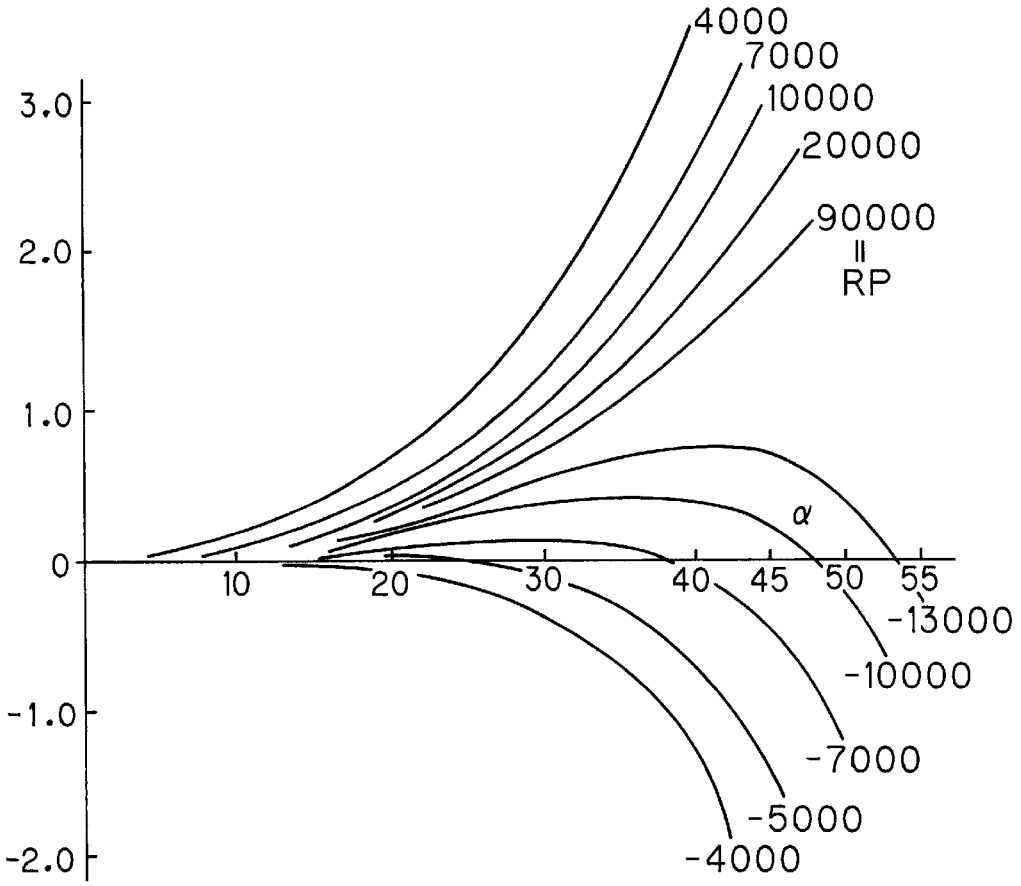
FIG. 5 is a diagram for illustrating an example of calculations according to the present invention.

FIG. 5 shows calculations with this model. In FIG. 5, the ordinate shows the quantity of apparent rise (mm) and the abscissa shows the angle α at which the viewer 19 sees the periphery of the phosphor screen 300. In FIG. 5, by using the radiuses of curvature RP (mm) as parameters, the quantities of rise at the periphery are normalized with the quantity of rise at the center of the screen. In FIG. 5, RP=90000 corresponds to a plane-parallel plate. From the calculations:

(1) The screen warps up at the periphery even with a plane-parallel plate panel.

(2) The quantity of rise becomes larger at the periphery as the radius of curvature becomes smaller.

(3) The characteristics shown in FIG. 5 are functions of the distance between the viewer 19 and the panel.

(4) The quantity of rise can be reduced with negative spherical radius.

Although these calculations were made by assuming that the inside surface was flat and the outside surface was in the concave form with respect to the Z-axis, optically almost the same results are obtained with the glass panel 100 turned over.

In the first preferred embodiment, as shown in FIG. 2, the panel 1 has its outside surface shaped in a convex form with respect to the Z-axis and its inside surface shaped in a linear form in cross-section in the vertical axis direction and in a convex form in cross-section in the horizontal axis direction, thereby reducing the quantity of rise at the periphery of the screen 3 to make the apparent screen 20 flatter. That is to say, it utilizes the factor for improvement with the negative spherical radius shown in FIG. 5. In the first preferred embodiment, forming the outside surface of the panel 1 in a convex form provides means for achieving the object of the invention, or the reduction in the rise at the periphery of the apparent screen 20, and forming the inside surface of the panel 1 in a linear section in the vertical axis direction facilitates application of the tension-type shadow grille 7. For the section in the horizontal axis direction, the panel is formed in a convex form with respect to the Z-axis by considering the pitch of the shadow grille 7, the quantity of off-axis SB of the electron beams at the deflection center plane 13, and the quantity of rise.

A-3. Characteristic Functions and Effects

Figure 26:
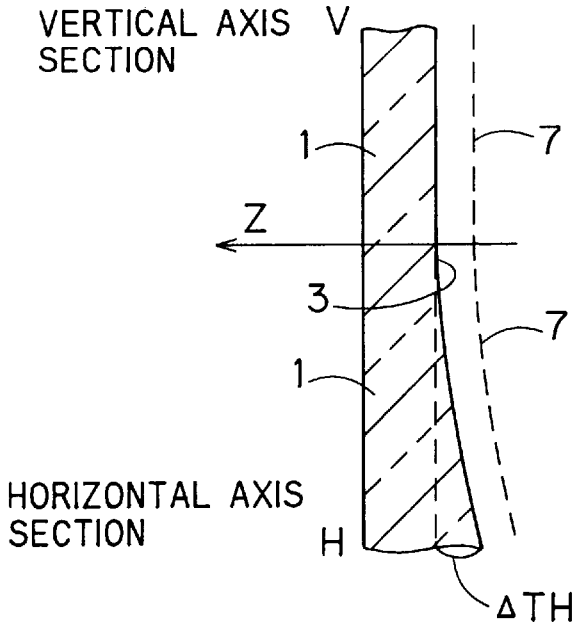
FIG. 26 is a sectional view showing a conventional improved panel.
Figure 27:
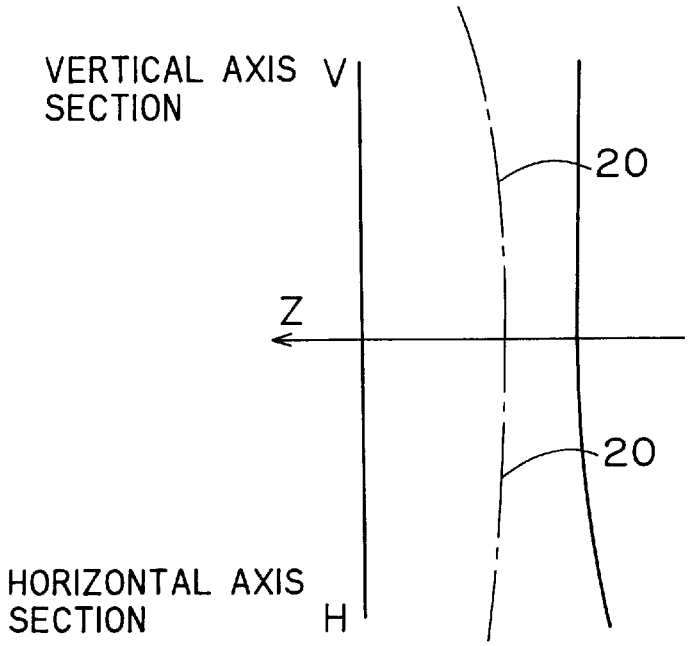
FIG. 27 is a diagram illustrating characteristics of the conventional improved panel.

In the first preferred embodiment, as has been stated, the apparent screen 20 can be made flatter since the outside surface is convex-shaped with respect to the Z-axis. For example, as compared with the conventional example described referring to FIG. 26, it is clearly improved with respect to the vertical axis direction. Furthermore, it is possible to use a tension-type shadow grille in extension of the conventional manner, since the inside surface of the panel has a linear section in the vertical axis (V) direction.

When the outside surface is formed in an aspherical surface as shown in FIG. 2, it produces an unnatural impression in the presence of light reflection. It is therefore preferable to provide a reflection reducing coating film 15 on the outside surface of the panel to remove extra light reflection.

Figure 3:
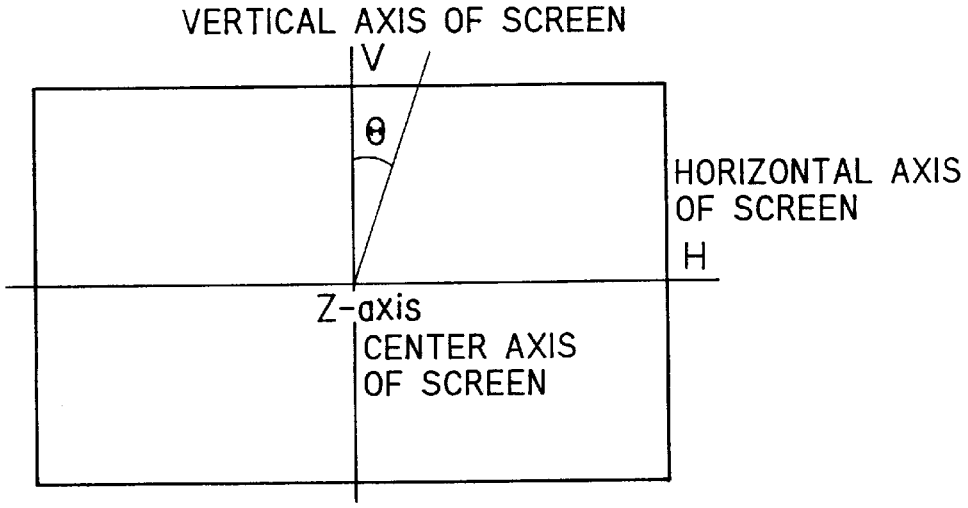
FIG. 3 is a plane view showing the screen for illustrating the principle of the first preferred embodiment.

The characteristics have been described in terms of shapes of the sections in the vertical axis (V) and horizontal axis (H) directions. The shape of the panel in the space between the two axes is not specifically limited as long as it is in a continuous and smooth form, for example. For example, in FIG. 3, with the radius of curvature RV of the vertical-axis (V) section and the radius of curvature RH of the horizontal-axis (H) section, if the radius of curvature R is defined with a sectional shape separated by Θ degrees from the vertical axis (V) and including the center, the interspace part may be shaped as given by the equation (1) below:

$$1/R^2=\cos^2\Theta/RV^2+\sin^2\Theta/RH^2.$$

This equation (1) is applicable to the aspherical surface on either of the outside and inside surfaces.

B. SECOND PREFERRED EMBODIMENT

B-1. Device Structure

Figure 6:
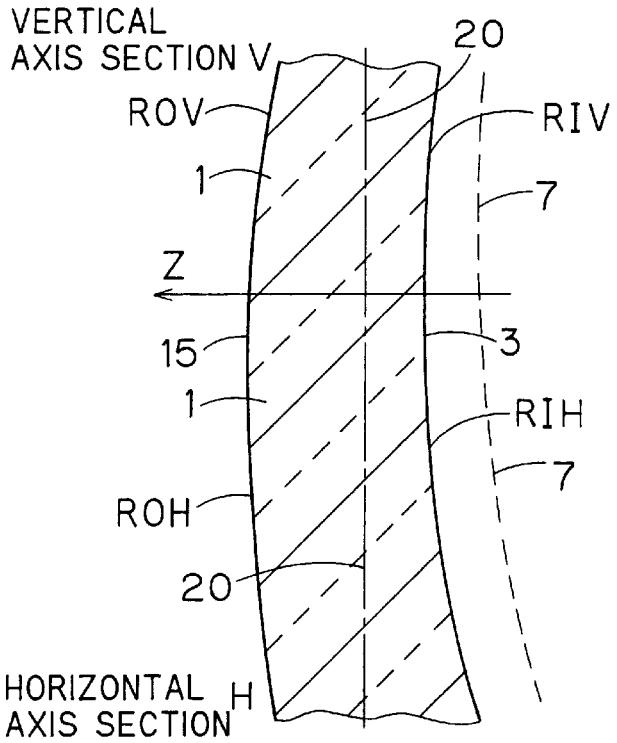
FIG. 6 is a sectional view showing the panel portion of a color picture tube having a tension-type shadow grille according to a second preferred embodiment of the present invention.

FIG. 6 is a sectional view showing the main part of the panel portion of a color picture tube device according to a second preferred embodiment of the present invention. The color picture tube device according to the second preferred embodiment is the same as that shown in FIG. 1 except in the sectional shape of the panel. In the second preferred embodiment, the outside surface of the panel 1 is the same as that shown in FIG. 2 in the first preferred embodiment. The inside surface of the panel 1 is shaped in a convex form with respect to the Z-axis both in the vertical axis (V) direction and the horizontal axis (H) direction.

B-2. Operation

Figure 7:
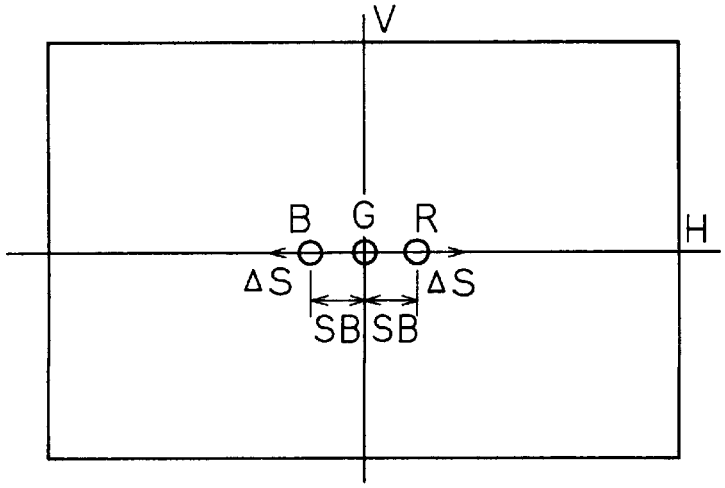
FIG. 7 is a plane view showing the screen for illustrating functions of the second preferred embodiment.

When using a panel shaped this way, as shown in FIG. 7, the change ΔS in the off-axis dimension SB of the electron beams 5 off from the Z-axis at the deflection center plane 13 of the both-side electron beams (refer to FIG. 1) is utilized in the vertical deflection. Specifically, the off-axis dimension of the electron beams 5 is changed from SB to SB+ΔS in the vertical deflection. Now, in FIG. 1, if the distance from the deflection center 14 to the periphery of the panel screen 3 is taken as L, the dimension q between the shadow grille 7 and the inside surface of the panel 1 is given by the equation (2) below:

$$q=La/3\ SB.$$

The equation (2) is for arranging the three-color phosphors in the densest structure on the phosphor screen 3. In the equation, "a" denotes the pitch of the shadow grille.

Figure 8:
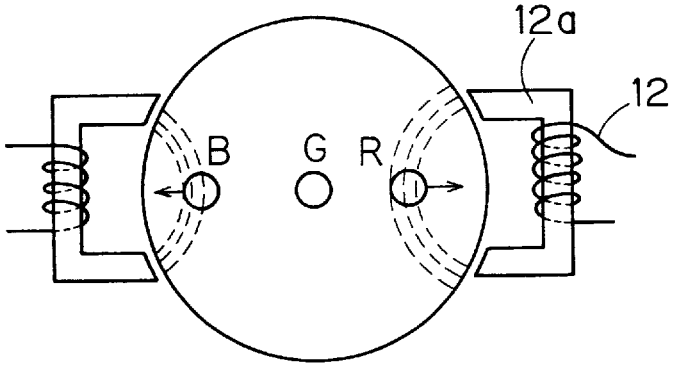
FIG. 8 is a diagram showing auxiliary coil used in the second preferred embodiment.

To enlarge SB in the vertical deflection to reduce q, it is necessary to change SB to SB+ΔS. For means for changing SB to SB+ΔS, the magnetic field produced by the vertical coil of the deflection yoke 6 is made still closer to a barrel form, or, as shown by the broken line in FIG. 1, an auxiliary coil 12 is provided on the back side of the deflection yoke 6 to generate a magnetic field component for producing ΔS, for example. As shown in FIG. 8, for the auxiliary coil 12, for example, an auxiliary coil 12 is wound around a silicon steel plate 12*a* to generate the magnetic field shown by the broken lines, thereby producing the component ΔS shown in FIG. 7.

B-3. Characteristic Functions and Effects

This structure allows the inside surface of the panel to be shaped in a convex form with respect to the Z-axis also in the vertical direction. Furthermore, in this case, forming the inside surface of the panel in the convex form with respect to the Z-axis reduces the rising component due to the convex shape of the outside surface, thus providing a flat apparent screen 20 with more desirable result. In the horizontal direction, it is constructed in the same way as that in the first preferred embodiment. The second preferred embodiment is more advantageous than the first preferred embodiment in respect of explosion-proof performance as a glass valve. For light reflection, a reflection reducing coating film 15 is preferably provided.

C. THIRD PREFERRED EMBODIMENT

Figure 9:
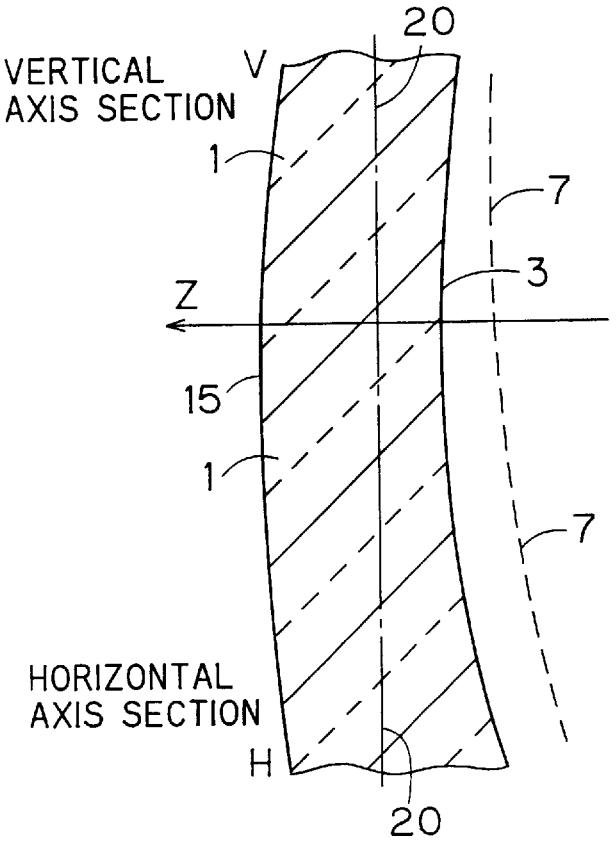
FIG. 9 is a sectional view showing the panel portion of a color picture tube device having a tension-type shadow grille according to a third preferred embodiment of the present invention.

FIG. 9 is a sectional view showing the main part of the panel portion of a color picture tube device according to a third preferred embodiment. The color picture tube device according to the third preferred embodiment is the same as that shown in FIG. 1 except in the sectional shape of the panel. In the third preferred embodiment, the outside surface of the panel 1 is formed in a rotation-symmetrical convex shape with respect to the Z-axis. This reduces the unnaturalness due to light reflection. It is preferable to provide a reflection reducing coating film 15 in this case, too. The inside surface of the panel 1 is formed in the same way as that in the second preferred embodiment.

D. FOURTH PREFERRED EMBODIMENT

The shapes of the inside and outside surfaces of the panel may be defined by considering ΔS, deflection characteristics, and the flatness of the apparent screen in the vertical axis (V) direction, and in the horizontal axis (H) direction, by considering the flatness of the apparent screen. Accordingly, the design margin is preferably within 2 mm all over the panel 1 as an anisotropic component in this case. Designing it in the horizontal axis direction requires considering only the quantity of rise. However, as to the vertical axis direction, it is necessary to design ΔS with only the deflection yoke 6, or also with the auxiliary coil 12, thus allowing somewhat smaller design margin. In this case, the trend of ΔSV>ΔSH is used to form the inside surface of the panel in the convex form in the vertical axis (V) direction.

E. FIFTH PREFERRED EMBODIMENT

E-1. Device Structure

Figure 10:
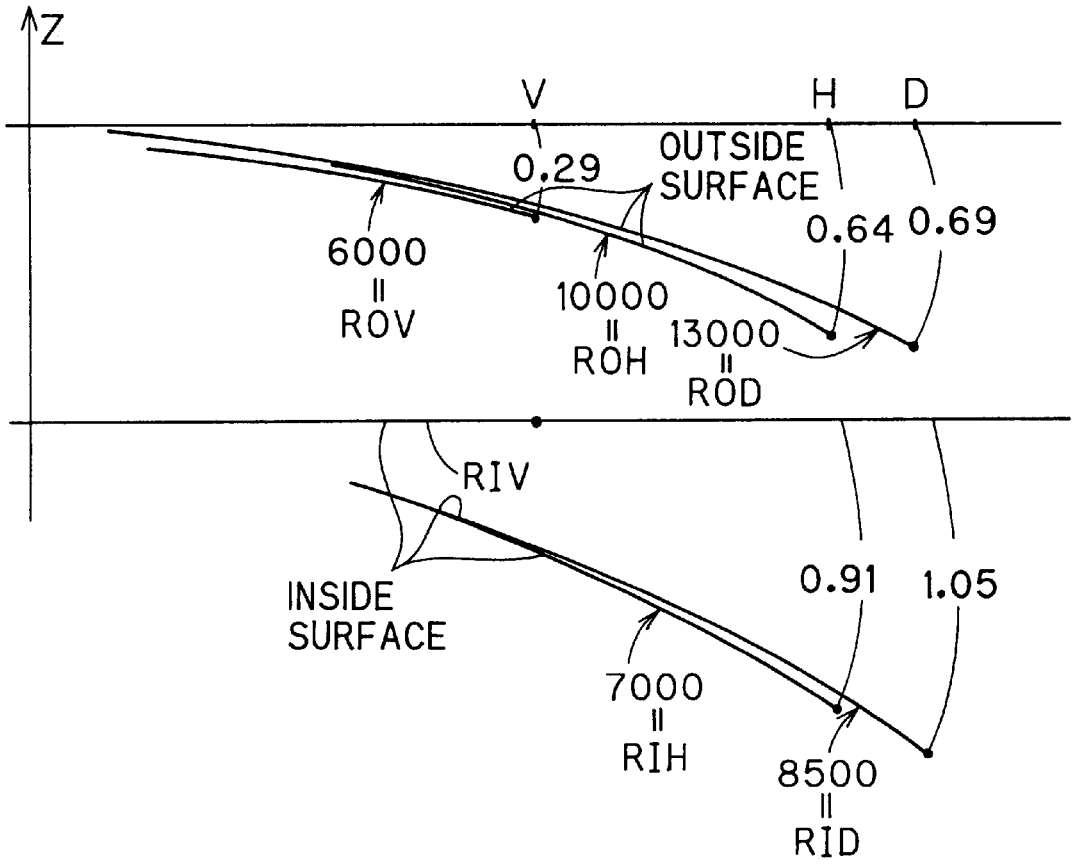
FIG. 10 is a diagram showing the quantities of wedge in the peripheral part of the screen with respect to curvatures of the inside and outside surfaces of the panel portion of a color picture tube device having a tension-type shadow grille according to a fifth preferred embodiment of the present invention.

FIG. 10 is a diagram showing the quantities of wedge at the periphery of the screen with respect to the curvatures of the inside and outside surfaces of the panel portion of a color picture tube according to a fifth preferred embodiment of the present invention. Table 1 shows specific calculations in FIG. 4 and FIG. 5 in the case of a picture tube having a diagonal dimension of 27 cm.

TABLE 1

| | 16:9 Screen | | | | | | |
|---|---|---|---|---|---|---|---|
| | a | b | c | RI | ei | RO | eo |
| D | 53° | 3.1 | 133.9 | 8500 | 1.05 | −13000 | 0.69 |
| H | 48° | 2.25 | 112.7 | 7000 | 0.91 | −10000 | 0.64 |
| V | 29° | 0.80 | 59.3 | infinity | 0 | −6000 | 0.29 |

Table 1 shows an example with a conventionally used phosphor screen 3 having an aspect ratio of 16:9, which corresponds to the possible worst case of a unit model as estimation of the rise of the apparent screen 20 when the distance from the viewer 19 to the center of the glass of the panel 100 is 95 mm as shown in FIG. 4.

In Table 1, D, H and V correspond to the diagonal axis, the horizontal axis and the vertical axis of the screen, respectively. The character "a" corresponds to the angle α on the abscissa in FIG. 5, which are 53°, 48° and 29°, with respect to the respective axes. The character "b" shows the quantity of rise (mm) in the case of use of a plane-parallel plate panel 1 (RP=90,000) in correspondence with α on the abscissa in FIG. 5. The character "c" shows the dimensions corresponding to the distances 1*h* and 1*v* in FIG. 23 and the distance from the Z-axis to an end of the diagonal axis. The radius of curvature RI of the inside surface of the panel is R7000 in the horizontal-axis section, for example. Accordingly, it is known from FIG. 5 that the quantity of rise in this case is 4.5 mm. To distinguish between the two radiuses of curvature RP of the outside and inside surfaces, the radius of curvature of the inside surface is shown as RI and that of the outside surface is shown as RO.

E-2. Operation

In the model shown in FIG. 4, it is supposed that the center of the panel 100 is at the distance of 95 mm from the position of the eyes of the viewer 19 and that the phosphor screen 300 is applied on the inner flat plane 13 mm off from it. If, in the reverse manner, the outside surface is flat and the R7000 phosphor screen is provided in a convex form with respect to the Z-axis (with respect to the direction of the eyes of the viewer 19), as shown in FIG. 10 (if the optical system is inverted), the characteristics can be regarded as optically almost the same. Accordingly, it rises by 2.25 mm at the end of the horizontal axis (H).

From the relation between the index of refraction and the thickness of the panel, the quantity of rise at the center of the screen on the plane-parallel plate panel is about 4.5 mm. On the other hand, with a panel having its inside surface formed as R7000, the quantity of rise at the center of the screen is about 5.2 mm. Accordingly, the difference in the quantity of rise, ΔΔP, between the plane-parallel plate panel and the panel with an R7000 inside surface is about 0.7 mm. Hence, when comparing the quantity of rise on the periphery of the panel with that at the center, it is given as 2.25 mm−0.7 mm=1.55 mm at the end of the horizontal axis (H). The difference in the quantity of rise between the center of the panel and the periphery of the panel can thus be reduced.

The quantity ei in Table 1 shows how the inside surface of the panel is raised with respect to the Z-axis, which is 0.91 mm in the horizontal axis (H) direction. The quantity eo shows how the outside surface of the panel is raised with respect to the Z-axis. FIG. 10 shows ei and eo with respect to the individual axes, where the three axes are drawn in an overlapped manner. In FIG. 10, the abscissa shows the distance from the center of the screen and the ordinate shows the Z-axis coordinates of the panel, which shows an outside surface in a convex form and an inside surface forming an aspherical surface, which is not a spherical surface nor a cylindrical surface, as shown in the figure.

Specifically, in Table 1, only the outside surface of the panel is formed in a convex form to correct part of the quantity of rise of the plane-parallel plate panel glass. Then, in this state, the peripheral part will be so thin as to be disadvantageous in respect of safety design of the picture tube. Accordingly, the inside surface of the panel is formed in a convex form with respect to the Z-axis to form a wedge. This reduces the quantity of rise by the value of ei as compared with the case of a flat inside surface. In this example, the outside surface of the panel has the following trend:

$$ROV=6000<ROH=10,000<ROD=13,000.$$

The inside surface of the panel has the following trend:

$$RIH=7000<RIV=\infty.$$

Although the example above has shown an example of a 27-cm picture tube, the trends are unchanged with a 51-cm picture tube, where the radiuses of curvature are specifically larger than those shown in this example.

Table 1 shows a numerically extreme example in the following respects:

A) The dimension (visual range) of 95 mm from the position of the eyes 19 to the screen center is not a common one, which, in practice, is appropriately about 300 to 500 mm even with a picture tube for display use. This shows that it is appropriate to use larger values as the radiuses of curvature shown in Table 1 when this example is applied to actual sizes.

B) The values about the inside surface of the panel were obtained to form the inside surface in a convex shape with respect to the Z-axis when its outside surface is flat for the purpose of correcting the quantity of rise at the periphery in the case of a plane-parallel plate. Hence it is not necessary to increase the values in terms of only the quantity of rise.

E-3. Characteristic Functions and Effects

With the structure described above, unlike the conventional case shown in FIG. 26, the quantity of rise can be freely adjusted in spite of the fact that the section in the vertical axis direction is formed linear for the use of a shadow grille, thus providing a picture tube with improved flatness. The structure of the fifth preferred embodiment may also be disadvantageous in respect of light reflection, since the outside surface of the panel is not spherical nor flat. A reflection reducing coating film is preferably provided on the outside of the panel as a countermeasure.

F. SIXTH PREFERRED EMBODIMENT

Figure 11:
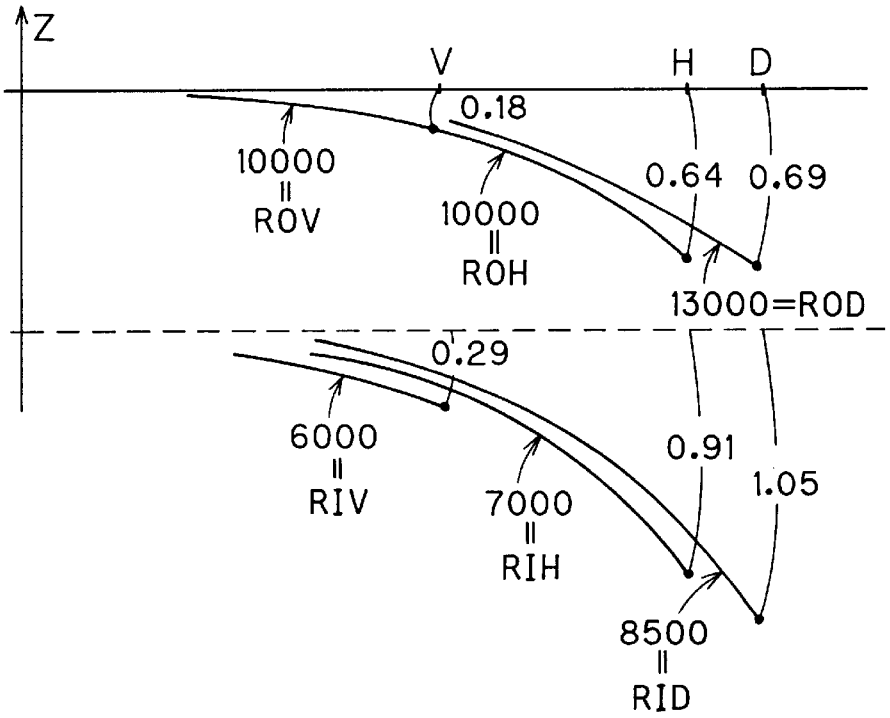
FIG. 11 is a diagram showing the quantities of wedge in the peripheral part of the screen with respect to curvatures of the inside and outside surfaces of the panel portion of a color picture tube device having a tension-type shadow grille according to a sixth preferred embodiment of the present invention.

FIG. 11 shows a sixth preferred embodiment, which has some wedge on the axes (the horizontal axis, vertical axis, and diagonal axis). This may be disadvantageous in the impression of flatness in respect of reflection on the outside surface of the panel since the outside surface of the panel is in a convex form, so that the structure is made so that RO>RI in the sections along the respective axes, where the radiuses of curvature of the outside surface of the panel are taken as RO and those of the inside surface are taken as RI. More specifically,

ROV=10,000>RIV=6000

ROH=10,000>RIH=7000

ROD=13,000>RID=8500.

As compared with that shown in FIG. 10, this preferred embodiment is more advantageous in respect of safety design of the picture tube, since it has increased wedge specifically in the vertical direction.

G. SEVENTH PREFERRED EMBODIMENT

Figure 12:
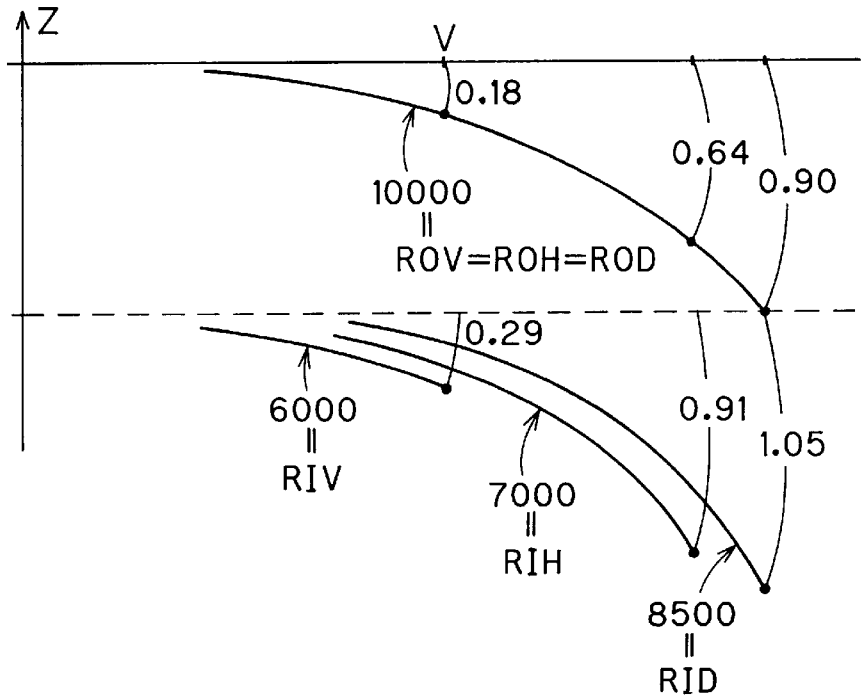
FIG. 12 is a diagram showing the quantities of wedge in the peripheral part of the screen with respect to curvatures of the inside and outside surfaces of the panel portion of a color picture tube device having a tension-type shadow grille according to a seventh preferred embodiment of the present invention.

FIG. 12 shows a seventh preferred embodiment, which corresponds to an example in which the outside surface of the panel in the sixth preferred embodiment is shaped in a rotation-symmetrical form with respect to the horizontal axis. The minimum radius of curvature can be R6000 as shown in FIG. 10. In this case, the degree of reflection on the outside surface of the panel is improved in quality as compared with that shown in FIG. 11.

H. EIGHTH PREFERRED EMBODIMENT

An eighth preferred embodiment corresponds to an example in which the outside surface of the panel shown in FIG. 10 is shaped in the same form as that shown in FIG. 12. In this case, the degree of reflection on the outside surface of the panel is further improved in quality at some sacrifice of the apparent flatness. In this case, of course, formation of a reflection reducing coating film on the outside surface of the panel compensates for the disadvantage caused by the convex form of the outside surface of the panel.

I. NINTH PREFERRED EMBODIMENT

I-1. Device Structure

Figure 13:
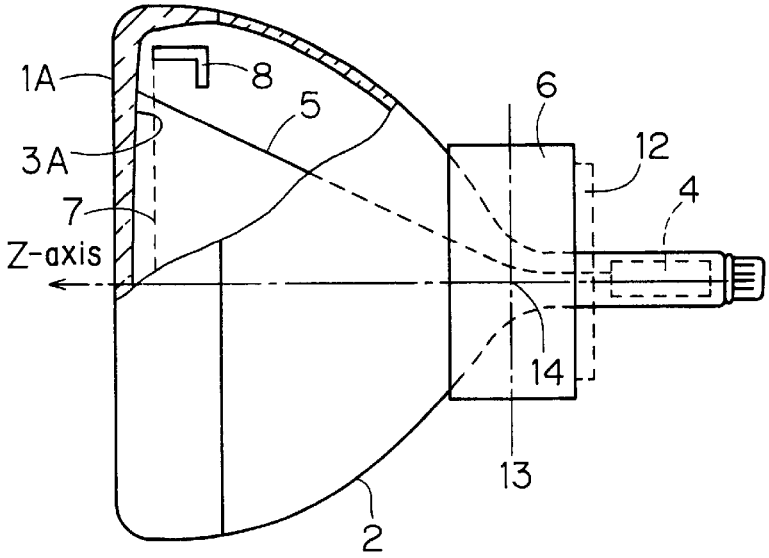
FIG. 13 is a partially sectional side view showing a color picture tube device having a tension-type shadow grille according to a ninth preferred embodiment of the present invention.

Now a ninth preferred embodiment of the present invention will be described with a picture tube having a diagonal dimension of 51 cm as shown in FIG. 13. The picture tube device shown in FIG. 13 has almost the same structure as the picture tube device according to the first preferred embodiment described referring to FIG. 1, where the same components are shown at the same reference characters and they are not described again.

In FIG. 13, the panel 1A has its outside surface formed almost flat and its inside surface formed as a convex, aspherical, and non-cylindrical surface with respect to the Z-axis.

Figure 14:
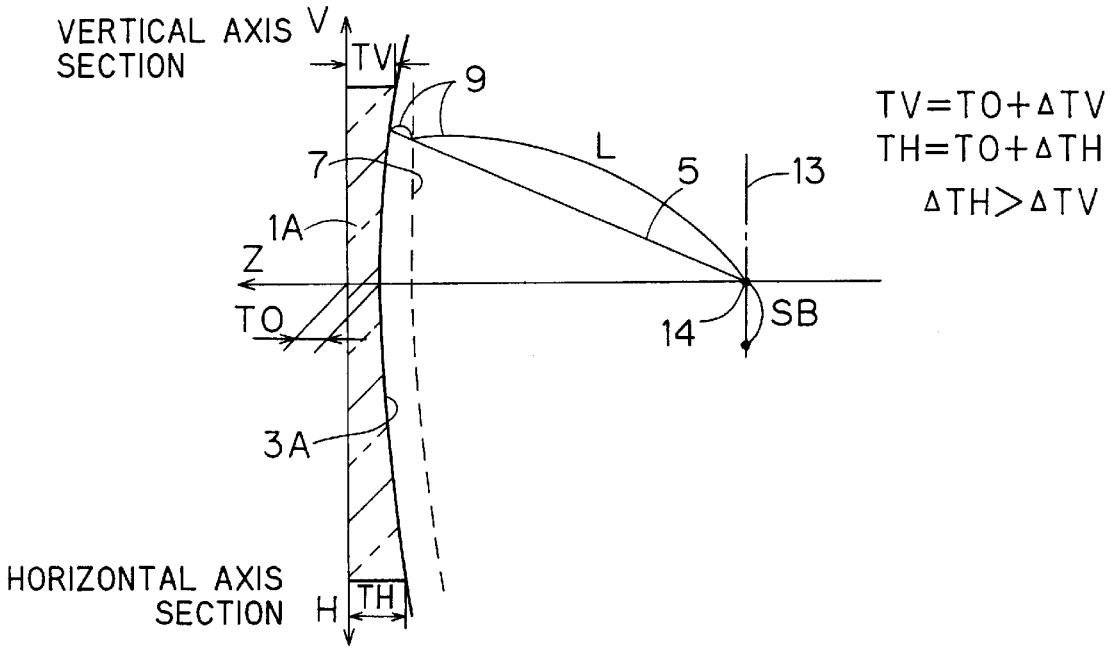
FIG. 14 is a sectional view showing the panel portion of the ninth preferred embodiment.

FIG. 14 is a section view showing the main part of the panel 1A, the phosphor screen 3A and the tension-type shadow grille 7 in an enlarged manner. The upper half in the drawing (the part above the Z-axis) shows the vertical-axis (V) section and the lower half (the part below the Z-axis) shows the horizontal-axis (H) section. As is clear from FIG. 14, the outside surface of the panel 1A is almost flat and its inside surface is formed in a convex form with respect to the Z-axis along both the vertical axis (V) and the horizontal axis (H).

When the glass thickness at the center of the panel 1A is taken as T0, the glass thickness at an end of the vertical axis (V) of the panel 1A is given as TV=T0+ΔTV. Similarly, the glass thickness at an end of the horizontal axis (H) is given as TH=T0+ΔTH. Here, ΔTV and ΔTH correspond to the differences in thickness between the panel center and the positions separated by 1*v* and 1*h* from the screen center Z shown in FIG. 15, which are referred to as "wedge". They are set so that 0<ΔTV<ΔTH.

Since the shadow grille 7 is tensed in the vertical axis (V) direction, its section in the vertical direction is almost parallel to the outside surface of the panel 1A. In the horizontal direction, the shadow grille 7 is formed in a curved surface determined on the basis of the pitch a of the slit-like apertures 11, the shape of the inside surface of the panel 1A, and the off-axis dimension SB from the Z-axis of the both-side electron beams at the deflection center plane 13.

I-2. Operation

Figure 15:
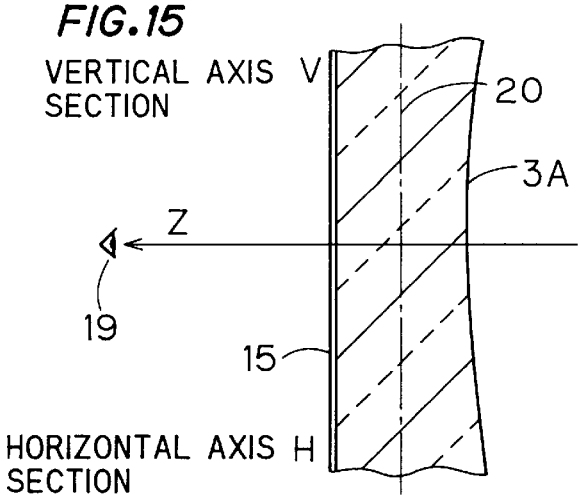
FIG. 15 is a sectional view showing the panel portion for illustrating operation of the ninth preferred embodiment.

FIG. 15 is a diagram illustrating effects of the above-described structure. In the drawing, the upper half shows the vertical-axis (V) section and the lower half shows the horizontal-axis (H) section. As has been described, in the panel 1A according to the ninth preferred embodiment, the outside surface is almost flat and the phosphor screen 3A is provided on the inside surface that is convex in the Z-axis direction. With this structure, when the viewer 19 is separated from the panel 1A by 50 cm, for example, the apparent screen 20 can be obtained as an almost flat screen 20 as shown by the one-dot chain line. Provided on the outside surface of the panel is the reflection reducing coating film 15.

The reason why the trouble occurs in the apparent screen with a conventional flat panel glass is not described again, for it has already been described referring to FIG. 4.

Figure 16:
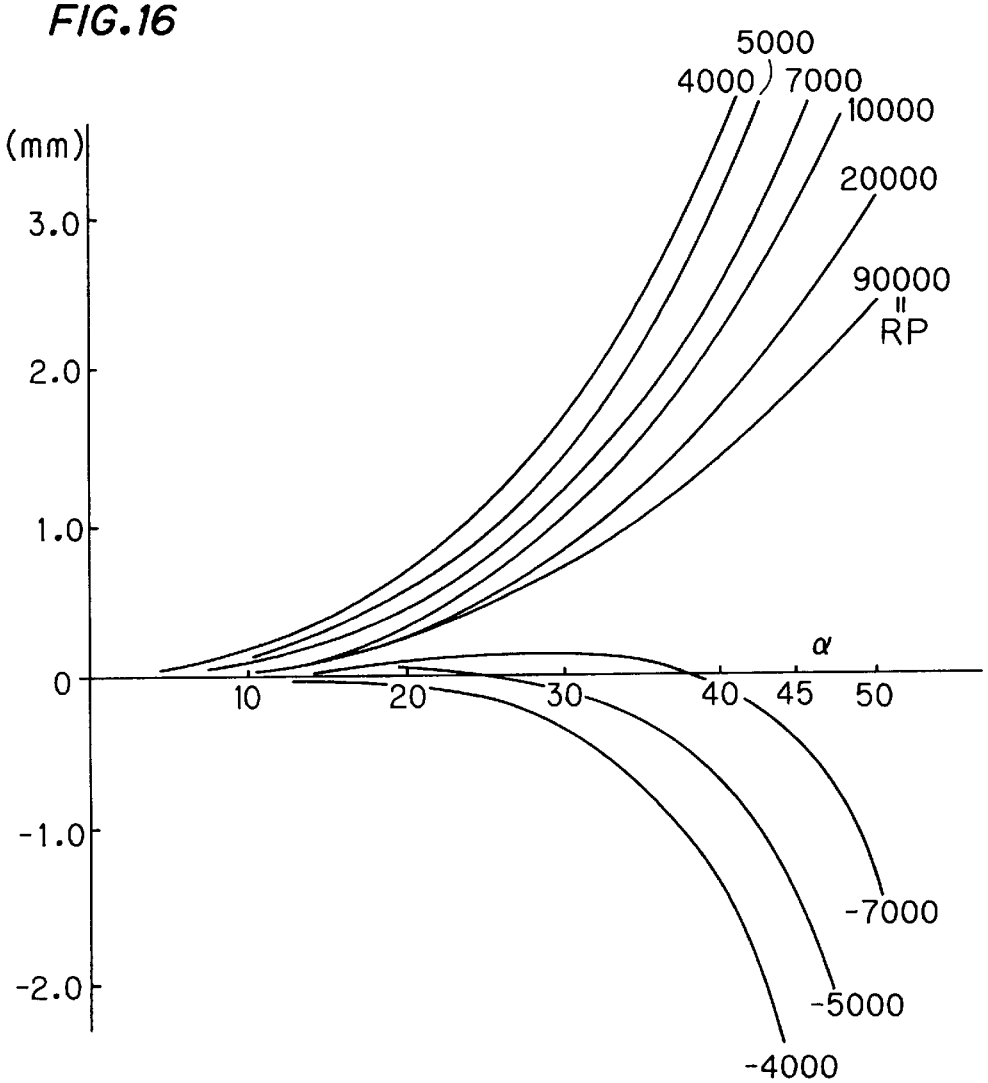
FIG. 16 is a diagram for illustrating the principle of the present invention.

Calculations with this model are shown in FIG. 16. In FIG. 16, the ordinate shows the quantity of apparent rise (mm) and the abscissa shows the angle α at which the periphery of the phosphor screen 300 is seen. In this drawing, the quantities of rise on the periphery are normalized with the quantity of rise at the center of the screen, by using the radiuses of curvature RP (mm) as parameters. In FIG. 16, RP=90000 can be regarded as the case of a plane-parallel plate. The calculations lead to the same conclusions as the conclusions (1) to (4) described in the first preferred embodiment.

I-3. Characteristic Functions and Effects

According to the ninth preferred embodiment, as shown in FIG. 14, the panel 1A has its outside surface formed in a flat shape and its inside surface formed in a convex shape with respect to the Z-axis to reduce the rise to obtain a flatter apparent screen. Further, it has wedge to suppress deterioration of static strength. That is to say, the formation of wedge can reduce the stresses constantly applied by atmospheric pressure when the inside of the CRT is evacuated to prevent damage to the CRT. Needless to say, improved flatness can be obtained when not only the apparent screen 20 but also the outside surface of the panel 1A is flat as shown in FIG. 15. On the other hand, the absence of extra light reflection is the most preferable. Therefore, the formation of the reflection reducing coating film 15 is preferable.

Although the characteristics have been described in terms of the shapes of the vertical-axis (V) section and the horizontal-axis (H) section, the panel can be formed without any limitations in the space between the two axes, as long as it is formed in a continuous and smooth shape. Accordingly, the shape in the interspace part may be determined on the basis of the equation (1) shown in the first preferred embodiment.

J. TENTH PREFERRED EMBODIMENT

J-1. Device Structure

Figure 18:
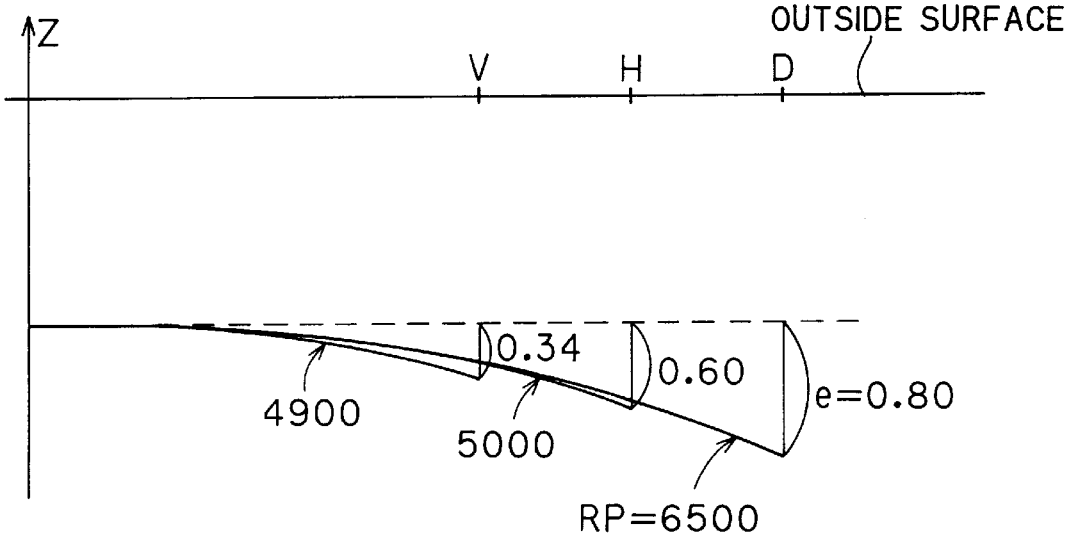
FIG. 18 is a diagram showing the quantities of wedge in the peripheral part of the screen with respect to curvatures of the inside and outside surfaces of the panel according to the tenth preferred embodiment.

FIG. 18 is a diagram showing the quantities of wedge at the periphery of the screen with respect to the curvatures of the inside and outside surfaces of the panel of a color picture tube device according to a tenth preferred embodiment of the present invention. In the tenth preferred embodiment, as well as in the ninth preferred embodiment, the outside surface of the panel is made flat and the inside surface of the panel is formed in an aspherical, non-cylindrical, and convex shape with respect to the Z-axis, where the thickness of the glass at the periphery of the panel screen is set in the relation of T0<TV<TH<TD. Where T0 indicates the glass thickness at the center of the panel, TV indicates that at the end of the vertical axis (V) of the screen of the panel, TH indicates the glass thickness at the end of the horizontal axis (H) of the screen of the panel, and TD indicates that at the end of the diagonal axis of the screen of the panel.

Table 2 shows specific calculations obtained by using FIG. 16 with a picture tube having a diagonal dimension of 20 cm and satisfying the conditions for thickness stated above.

TABLE 2

| | 4:3 Screen | | | | |
|---|---|---|---|---|---|
| | a | b | c | RP | e |
| D | 45° | 2.0 | 101.7 | 6500 | 0.80 |
| H | 37° | 1.2 | 77.5 | 5000 | 0.60 |
| V | 29° | 0.75 | 57.3 | 4900 | 0.34 |

This example corresponds to the worst case of estimation of the rise of the apparent screen in which the phosphor screen 3 has a ratio of height to width of 3:4 and the distance between the viewer 19 and the center of the panel glass is 95 mm as shown in FIG. 4.

J-2. Operation

In Table 2, D, H, and V correspond to the diagonal axis, the horizontal axis, and the vertical axis of the screen, respectively. The character "a" corresponds to the angle α on the abscissa shown in FIG. 16, which are 53°, 48° and 29° with respect to the respective axes. The character "b" shows the quantity of rise (mm) corresponding to α on the abscissa in FIG. 16 in the case of a plane-parallel plate panel (RP=90,000). The character "c" denotes the dimensions corresponding to 1*h* and 1*v* in FIG. 23 and the distance from the Z-axis to an end of the diagonal axis. For RP, when RP is R5000 and α=37, it is known from FIG. 16 that the quantity of rise in this case is 2.4 mm in the horizontal-axis section, for example.

Figure 17:
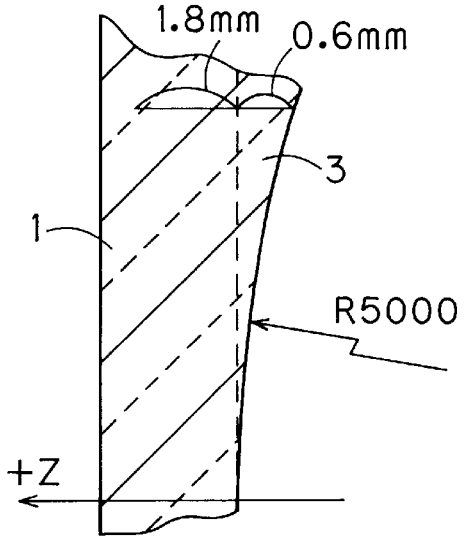
FIG. 17 is a sectional view showing the panel portion of a color picture tube device having a tension-type shadow grille according to a tenth preferred embodiment of the present invention.

In the model shown in FIG. 4, it is supposed that the center of the panel 100 is at the distance of 95 mm from the position of the eyes of the viewer 19 and the phosphor screen 300 is applied on the inner flat (plane-parallel) plane spaced 13 mm away from it. When, in the reverse manner, the flat surface is located on the outside and an R5000 phosphor screen is provided in a convex form with respect to the Z-axis (with respect to the direction of the eyes of the viewer 19) as shown in FIG. 17, that is to say, when the optical system is inverted, the characteristics can be regarded as optically almost the same. Specifically, at the periphery of the panel in the horizontal axis direction, or at the position of 1*h* in FIG. 23, the apparent screen position is located 2.4 mm inside. Here, since the periphery of the panel in the horizontal axis direction is at the position of minus 0.6 mm from the center position of the inside surface of the panel, the quantity of rise of the apparent screen is +1.8 mm. On the other hand, at the center of the screen, since the difference in the quantity of rise resulted from the use of the R5000 inside surface, ΔΔP, is about 1.0 mm, the quantity of final rise is about 0.8 mm. As compared with the quantity of rise of 1.2 mm with a conventional plane-parallel plate, the difference between the center part and the periphery can thus be reduced.

J-3. Characteristic Functions and Effects

It is thus possible to make the apparent screen along the individual axes closer to flat. The quantity e in Table 2 shows how it is raised as compared with a flat plate, which is 0.6 mm in the horizontal axis (H) direction. FIG. 18 shows values of e with respect to the individual axes, where the three axes are drawn in an overlapped manner. In FIG. 18, the abscissa shows the distance from the center of the screen and the ordinate shows the Z-axis coordinates of the panel, which shows a flat outside surface and an inside surface in the form of an aspherical surface, which is not a spherical surface nor a cylindrical surface in cross-sections along the respective axes, as shown in the drawing. This trend is unchanged even if the phosphor screen is increased in size, where the radiuses of curvature will specifically be larger than those shown here.

K. ELEVENTH PREFERRED EMBODIMENT

Figure 19:
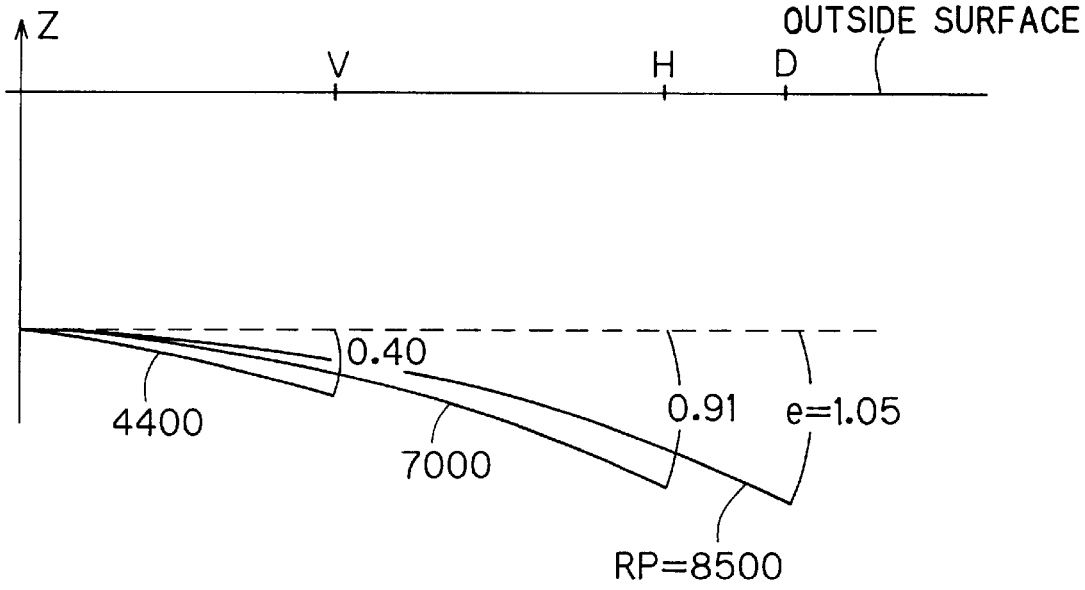
FIG. 19 is a diagram showing the quantities of wedge in the peripheral part of the screen with respect to curvatures of the outside and inside surfaces of the panel according to an eleventh preferred embodiment.

FIG. 19 is a diagram showing the quantities of wedge at the periphery of the screen with respect to the curvatures of the inside and outside surfaces of the panel of a color picture tube device according to an eleventh preferred embodiment. Table 3 shows calculations with a 27-cm wide tube with a 16:9 phosphor screen in the case where the thickness of the panel glass is set as T0<TV<TH<TD, as in the tenth preferred embodiment.

TABLE 3

| | 16:9 Screen | | | | |
|---|---|---|---|---|---|
| | a | b | c | RP | e |
| D | 53° | 3.1 | 133.9 | 8500 | 1.05 |
| H | 48° | 2.25 | 112.7 | 7000 | 0.91 |
| V | 29° | 0.80 | 59.3 | 4400 | 0.40 |

L. TWELFTH PREFERRED EMBODIMENT

L-1. Device Structure

Next, a twelfth preferred embodiment will be described referring to FIG. 7, FIG. 8 and FIG. 20. In the twelfth preferred embodiment, the quantity of off-axis SB from the Z-axis of the both-side electron beams at the deflection center plane 13 (refer to FIG. 13) is increased in the vertical deflection to ensure quantity of wedge by the deflection yoke. For means for this purpose, the magnetic field characteristics of the vertical coil of the deflection yoke or the auxiliary coil 12 shown in FIG. 13 is utilized. In the auxiliary coil 12, as shown in FIG. 8, the auxiliary coil 12 is wound around the silicon steel plate 12*a* to generate the magnetic field shown by the broken lines.

L-2. Operation

When the distance from the deflection center 14 to the periphery of the phosphor screen 3 is taken as L as shown in FIG. 14, the dimension q between the shadow grille 7 and the inside surface of the panel 1A is represented by the equation (2) shown in the second preferred embodiment. In the vertical direction, for the purpose of obtaining the wedge of ΔTV (to increase SB and decrease q), the value of SB is changed to SB+ΔS to increase the value of SB in the equation above.

For means for obtaining the component of ΔS, the magnetic field by the vertical coil of the deflection yoke 6 is formed in a direction still closer to a barrel than in conventional ones and than in the horizontal direction, to finally produce the wedge on the panel glass in the vertical direction. For another means for producing ΔS, such magnetic-field-producing current as will generate ΔS is passed to the auxiliary coil 12.

Figure 20:
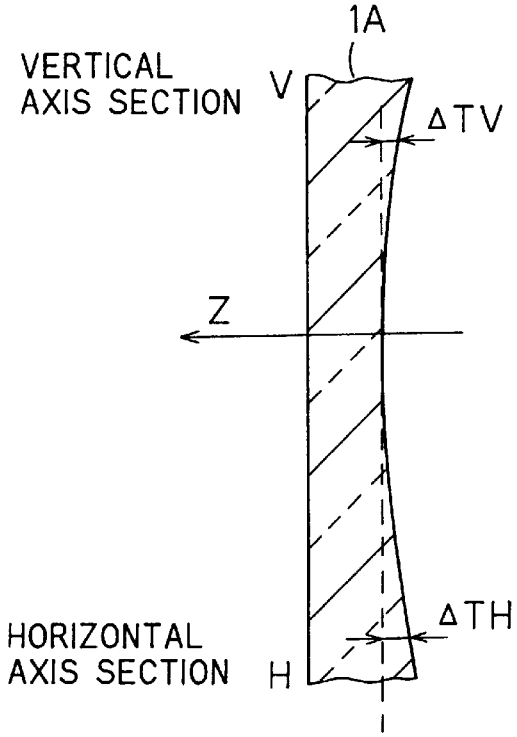
FIG. 20 is a sectional view showing the panel portion of a color picture tube device having a tension-type shadow grille according to a twelfth preferred embodiment of the present invention.

FIG. 20 shows a section of the panel 1A in the twelfth preferred embodiment. As shown in FIG. 20, the outside surface of the panel 1A is flat and its inside surface is convex with respect to the Z-axis. Furthermore, the quantity of wedge ΔTV in the vertical direction and the quantity of wedge ΔTH in the horizontal direction with respect to the thickness T0 at the center of the panel are made different, as ΔTV<ΔTH, for example. Specifically, they can be set as ΔTV=1.5 mm and ΔTH=2.0 mm, for example.

L-3. Characteristic Functions and Effects

Designing it in the horizontal direction requires considering only the quantity of rise for ΔTH. For ΔTV in the vertical direction, the dimension q between the shadow grille 7 and the inside surface of the panel 1 is important in relation to the arrangement of the beams R, G and B. In this example, since the shadow grille 7 is tensed in one direction, the magnetic field produced by the vertical coil of the deflection yoke 6 is made in a direction still closer to a barrel, and the auxiliary coil 12 is provided on the electron gun side of the deflection yoke 6 as shown by the broken line in FIG. 13 to enlarge SB and reduce q, thereby ensuring ΔTV. This allows formation of a sufficient wedge also in the vertical direction.

While the invention has been described in detail, the foregoing description is in all aspects illustrative and not restrictive. It is understood that numerous other modifications and variations can be devised without departing from the scope of the invention.

We claim:

1. A color picture tube device having a panel forming at least part of an envelope and a tension-type shadow grille facing a screen formed on an inside surface of the panel, wherein an axis extending from a center of the screen toward a viewer in a perpendicular direction corresponds to a Z-axis, said panel having an outside surface with a convex shape in the Z-axis direction in sections extending along a vertical axis direction and a horizontal axis direction of said screen, and said panel having an inside surface with a substantially flat shape in the section extending in the vertical axis direction and having a convex shape with respect to the Z-axis in the section extending in the horizontal axis direction.

2. The color picture tube device having the tension-type shadow grille according to claim 1, wherein, when the radius of curvature of the outside surface in the section in the vertical axis direction is taken as ROV, and the radius of curvature of the outside surface in the section in the horizontal axis direction is taken as ROH, the outside surface of said panel is shaped in a convex form having the relation of ROV<ROH.

3. The color picture tube device having the tension-type shadow grille according to claim 1, wherein the outside surface of said panel is in a rotation-symmetrical convex form with respect to the Z-axis.

4. A color picture tube device having a panel forming at least part of an envelope and a tension-type shadow grille facing a screen formed on an inside surface of said panel, said panel having an outside surface shaped in an approximately flat form with a radius of curvature of 6000 mm or larger, and the inside surface of said panel having a convex shape with respect to the Z-axis in a section extending in the vertical axis direction and in a section extending in the horizontal axis direction.

5. The color picture tube device having the tension-type shadow grille according to claim 4, wherein the outside surface of said panel is in a rotation-symmetrical convex form with respect to the Z-axis.

6. The color picture tube device having the tension-type shadow grille according to claim 4, wherein the radiuses of curvature of the outside surface of said panel in the section extending in the vertical axis direction, in the section extending in the horizontal axis direction and in a section extending in a diagonal axis direction are taken as RO, and the radiuses of curvature of the inside surface of said panel in the section extending in the vertical axis direction, in the section extending in the horizontal axis direction and in the section in the diagonal axis direction are taken as RI, the outside surface and the inside surface of said panel are in convex forms having the relation RO>RI in the respective sections along each of the axes.

7. The color picture tube device having the tension-type shadow grille according to claim 4, wherein the shape of the inside surface of said panel is determined such that:

in the section extending in the vertical axis direction, the inside surface shape is determined on the basis of a quantity of change in position, ΔS, of two electron beams on both sides among the three electron beams at the deflection center plane for the electron beams and deflection characteristics, and in the section extending in the horizontal axis direction, the inside surface shape is determined so that an apparent screen formed inside said panel is substantially flat.

8. The color picture tube device having the tension-type shadow grille according to claim 7, wherein the quantity of change in position, ΔS, of the two electron beams is given as different values in vertical deflection and horizontal deflection.

9. The color picture tube device having the tension-type shadow grille according to claim 8, wherein the quantity of change in position, ΔS, of the two electron beams corresponds to a quantity of change in a direction in which the two electron beams are separated away from the Z-axis, and the quantity of change in position, ΔS, of the two electron beams is given as a larger value in the vertical deflection than in the horizontal deflection.

10. The color picture tube device having the tension-type shadow grille according to claim 9, further comprising:

a deflection yoke for electromagnetically deflecting the electron beams, wherein said deflection yoke generates magnetic field for vertical deflection having a distribution approximating a barrel form distortion to separate the two electron beams away from the Z-axis.

11. The color picture tube device having the tension-type shadow grille according to claim 10, further comprising:

an auxiliary coil provided on the electron gun side of said deflection yoke, said auxiliary coil generating magnetic field affecting the electron beams, wherein the two electron beams are separated from the Z-axis by using the magnetic field generated by said auxiliary coil.

12. A color picture tube device having a panel forming at least part of an envelope and a tension-type shadow grille facing a screen formed on an inside surface of said panel, wherein the inside surface of said panel is formed so that a thickness at a periphery of said panel corresponding to the screen is larger than a thickness at a center of said panel and so that a thickness in a section extending in a vertical axis direction of said panel corresponding to the screen is different from a thickness in a section extending in a horizontal axis direction, wherein, when the thickness at the center of said panel corresponding to the screen is taken as T0, the thickness at an end of the section extending in the vertical axis direction of said panel corresponding to the screen is taken as TV, the thickness at an end of the section extending in the horizontal axis direction of said panel corresponding to the screen is taken as TH, and a thickness at an end of the section in a diagonal axis direction of said panel corresponding to the screen is taken as TD, the relation T0<TV<TH<TD is satisfied.

13. The color picture tube device having the tension-type shadow grille according to claim 12, wherein, when the radius of curvature of the inside surface of said panel in the section extending in the vertical axis direction is taken as RV, the radius of curvature of the inside surface of said panel in the section extending in the horizontal axis direction is taken as RH, and the radius of curvature of the inside surface of said panel in the section extending in the diagonal axis direction is taken as RD, then the inside surface of said panel is in a convex form having the relation RV<RH<RD.

14. The color picture tube device having the tension-type shadow grille according to claim 12, wherein the outside surface of said panel is substantially flat.

15. The color picture tube device having the tension-type shadow grille according to claim 12, wherein the thickness of said panel is determined such that:

in the section extending in the vertical axis direction, the panel thickness is determined on the basis of a quantity of change in position, ΔS, of two electron beams on both sides among the three electron beams at the deflection center plane for the electron beams and deflection characteristics, and so that an apparent screen formed inside said panel is substantially flat, and in the section extending in the horizontal axis direction, the panel thickness is determined so that the apparent screen is substantially flat.

16. The color picture tube device having the tension-type shadow grille according to claim 15, wherein the quantity of change in position, ΔS, of the two electron beams is given as different values in vertical deflection and horizontal deflection.

17. The color picture tube device having the tension-type shadow grille according to claim 16, wherein the quantity of change in position, ΔS, of the two electron beams corresponds to a quantity of change in a direction in which the two electron beams are separated away from the Z-axis, and the quantity of change in position, ΔS, of the two electron beams is given as a larger value in the vertical deflection than in the horizontal deflection.

18. The color picture tube device having the tension-type shadow grille according to claim 17, further comprising:

a deflection yoke for electromagnetically deflecting the electron beams, wherein said deflection yoke generates magnetic field for vertical deflection having a distribution approximating a barrel form distortion to separate the two electron beams away from the Z-axis.

19. The color picture tube device having the tension-type shadow grille according to claim 18, further comprising:

an auxiliary coil provided on the electron gun side of said deflection yoke, said auxiliary coil generating magnetic field affecting the electron beams, wherein the two electron beams are separated from the Z-axis by using the magnetic field generated by said auxiliary coil.

20. The color picture tube device having the tension-type shadow grille according to claim 12, wherein the inside surface of said panel is an aspherical or non-cylindrical surface.

* * * * *